US008713816B2

(12) United States Patent
Al-Sabah

(10) Patent No.: US 8,713,816 B2
(45) Date of Patent: May 6, 2014

(54) VENTILATING SHOE

(76) Inventor: Shka Amthal Al-Ahmad Al-Sabah, Shamiya (KW)

( * ) Notice: Subject to any disclaimer, the term of this patent is extended or adjusted under 35 U.S.C. 154(b) by 482 days.

(21) Appl. No.: 13/034,200

(22) Filed: Feb. 24, 2011

(65) Prior Publication Data

US 2012/0216431 A1 Aug. 30, 2012

(51) Int. Cl.
*A43B 7/08* (2006.01)

(52) U.S. Cl.
USPC ..... 36/3 B; 36/3 R; 36/3 A

(58) Field of Classification Search
USPC ..... 36/3 B, 3 A, 3 R, 15, 29
See application file for complete search history.

(56) References Cited

U.S. PATENT DOCUMENTS 3,012,342 A * 12/1961 Ramirez ..... 36/3 B
3,118,468 A * 1/1964 Bochan ..... 137/846
4,776,110 A 10/1988 Shiang
4,939,851 A * 7/1990 Miller ..... 36/3 B
5,010,661 A 4/1991 Chu
5,261,169 A 11/1993 Williford
5,399,404 A 3/1995 Laughlin et al.
5,732,485 A 3/1998 Laughlin et al.
5,829,167 A 11/1998 Valenzuela
5,921,003 A * 7/1999 Kim ..... 36/3 B
6,227,458 B1 5/2001 Dever et al.
7,146,750 B2 * 12/2006 Issler ..... 36/3 B
2003/0136023 A1 * 7/2003 Chen ..... 36/3 R
2008/0229623 A1 * 9/2008 Ferretti ..... 36/3 B

* cited by examiner

*Primary Examiner* — Ted Kavanaugh
(74) *Attorney, Agent, or Firm* — Lowe Hauptman & Ham, LLP

(57) ABSTRACT

A ventilating shoe including a removable deodorant and/or a perfumed pad includes a water resistant sole, an upper shoe portion and connecting means for fastening the sole to the upper shoe portion. A series of closely spaced small openings are disposed between the sole and the upper shoe portion surrounding the shoe with the exception of a back portion thereof. In addition, an open porous pad impregnated with a deodorant and/or perfume and a longitudinally extending air chamber are provided.

5 Claims, 3 Drawing Sheets

VENTILATING SHOE

FIELD OF THE INVENTION

This invention relates to a ventilating shoe and more particularly to a ventilating shoe that includes a removable deodorant and/or perfumed pad.

BACKGROUND FOR THE INVENTION

Foot odor and infections are common problems associated with microbial growth in the enclosed environment of a shoe. Moisture resulting from foot perspiration provides an ideal growth environment for both bacteria and fungus causing odor and athlete's foot, respectively.

The inhibition of such microbial growth has been a long sought goal of the shoe industry, and numerous approaches have been proposed and tried. Commonly, activated carbon is incorporated into a shoe insole in an effort to absorb odors and moisture. Although partly effective in controlling odor, the degree of moisture absorption is not sufficient to inhibit microbial growth in most cases. Thus, the odor continues to be produced and athlete's feet and other infections can occur. Moreover, the ability of the activated carbon to absorb odor is quite limited and the effectiveness of the insole is usually short lived.

Antimicrobial agents have also been incorporated within a shoe insole with varying degrees of success. Usually, however, the antimicrobial agents are either released too rapidly to provide for long-term effectiveness or entrapped too securely within the insole to provide for sufficient activity.

In view of the above, there have been a number of approaches for deodorizing shoes. For example, a U.S. Pat. No. 4,776,110 of Shiang discloses an insole-ventilating shoe including an insole having an air pumping device formed on a rear portion of the insole. The insole has an inner guide protruding upwardly to exchange fresh air outside of the shoe vamp, and plural ventilating grooves with through holes formed on a front portion of the insole for circulating air from the pumping device in the insole and shoe for comforting an individual's foot.

A more recent U.S. Pat. No. 5,010,661 of Chu discloses a unidirectional airflow ventilating shoe and a unidirectional airflow ventilating insole for shoes. As disclosed, a unidirectional airflow ventilating shoe having an ordinary upper and sole. A unidirectional airflow ventilating layer (1) is provided on the sole inside the shoe. The ventilating layer has a compressible cavity (2), air inlet (3), main airflow passage (4), branches (5) and air outlets (6). Fresh air outside the shoe is unidirectionally sucked into the ventilating layer and blown out to a fore part inside the shoe.

For convenience sake, a unidirectional airflow ventilating insole can be made for any kind of shoes. The insole comprises an upper portion (7) and lower portion (8). The structure and shape of the upper portion is the same as that of the ventilating layer (1). Lower portion (8) can either form an entirety with upper portion (7), or be an elastic substrate adhered to the bottom surface of the upper portion with adhesives. The insole can be used in any kind of shoes and attain the same result as unidirectional airflow ventilating shoes.

Finally, a U.S. Pat. No. 6,227,458 of Dever et al. discloses a deodorizer for masking foot and shoe odors through controlled release of fragrance and which utilizes releasable interlocking surfaces for retaining the deodorizer in contact with the shoe.

Notwithstanding the above it is presently believed that there is a need and a potential commercial market for a ventilating shoe that includes a removable deodorant and/or perfumed pad. There should be a demand because such shoes incorporate a removable pad that can be easily and readily replaced with a relatively inexpensive insole that contains a deodorant and/or perfume pad. In addition, the shoes contain a unique ventilating structure that helps to aerate the shoe to reduce moisture and odor together with an air cushion under the insole. Further, it is desirable to provide a convenient deodorizer for masking foot and shoe odors in which the perfume component can be easily applied to and removed from the shoe interior, is comfortable to use and incorporates a unique valve arrangement that allows air to be drawn into the shoe and at the same time tends to resist the outflow of air through such inlets.

BRIEF SUMMARY OF THE INVENTION

In essence the present invention contemplates a ventilating shoe that includes a removable deodorant and/or perfumed pad. The shoe includes a water resistant sole having an upper and lower surface in the general shape of a human foot and an upper shoe portion with an opening and a tongue in an upper portion thereof. The shoe also includes means for closing the opening to thereby envelop an individual's foot. In addition, the shoe contains connecting means attaching the upper show portion to the sole. A series of small openings are provided between the sole and the upper shoe portion and surround the sole on each side thereof with the exception of the back of the shoe. An open porous pad and a deodorant and/or perfume impregnating the pad is provided while a longitudinal extending air chamber under the porous pad includes a vent in a rear surface of the sole for admitting air into the chamber and an opening in the back portion of the shoe allows for inserting and removing the porous pad from the shoe. Finally, each of the small openings and the vent each include a pair of generally S-shaped overlapping elements to permit ingress of air into the shoe and slightly resist the outflow of air through adjacent small openings.

The invention will now be described in connection with the accompanying drawings wherein like reference numerals have been used to indicate like parts.

DESCRIPTION OF THE PREFERRED EMBODIMENTS OF THE INVENTION

Figure 1:
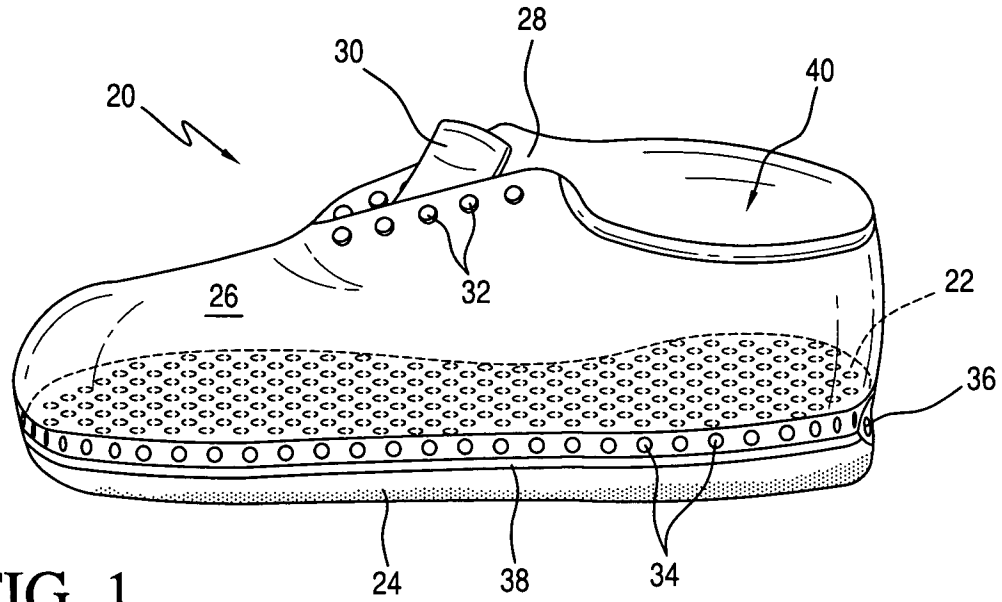
FIG. 1 is a perspective view of a shoe in accordance with a first embodiment of the invention.

As shown in FIG. 1, a ventilating shoe 20 includes a deodorant and/or perfumed pad 22 disposed between a sole 24 and an upper shoe portion 26. The upper shoe portion 26 includes a conventional opening 28 in an upper surface thereof and a tongue 30 as well as plurality of small openings 32 for laces (not shown). The upper shoe portion 26 is preferably made of leather and is attached to a leather or a rubber sole 24 in a conventional manner as for example by stitching.

One feature of the invention resides in a plurality of small openings 34 between the sole 24 and the upper shoe portion 26 slightly above the sole. These openings 34 that may be spaced as little as ¼ to ¼ inch from one another extend around a forward portion and both sides of the shoe 20 and may extend partially around the back of the shoe. However, the back of the shoe includes a valve assembly 36 that communicates with a longitudinally extending air chamber 38 that extends along the length of the shoe 20 between the sole 24 and pad 22. The rear portion of the shoe 20 also includes an opening 40 (FIGS. 1 and 3) for inserting and/or removing a deodorant and/or perfumed pad 22.

Figure 2:
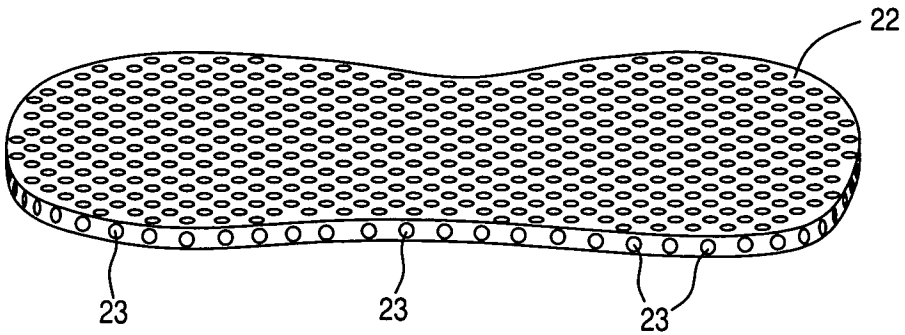
FIG. 2 is a perspective view of an open porous insole for use in a shoe in accordance with a first embodiment of the invention.

A deodorant and/or perfumed pad 22 or insole is shown in FIG. 2 as a generally foot shaped open porous pad with a plurality of openings 23 extending around the pad. The pad is shown more clearly in FIG. 2. The open porous pad 22 has a generally foot shape with a thickness of about 3 mm and a plurality of openings 23 around the periphery thereof that are typically spaced at about ¼ to ¼ inch one from another. The openings 23 are generally aligned with the openings 34 in the shoe 20 so that air entering the shoe through openings 34 enters into the pad 22 and pass upwardly through the upper shoe portion 26 as shown in FIG. 3.

Figures 3, 4:
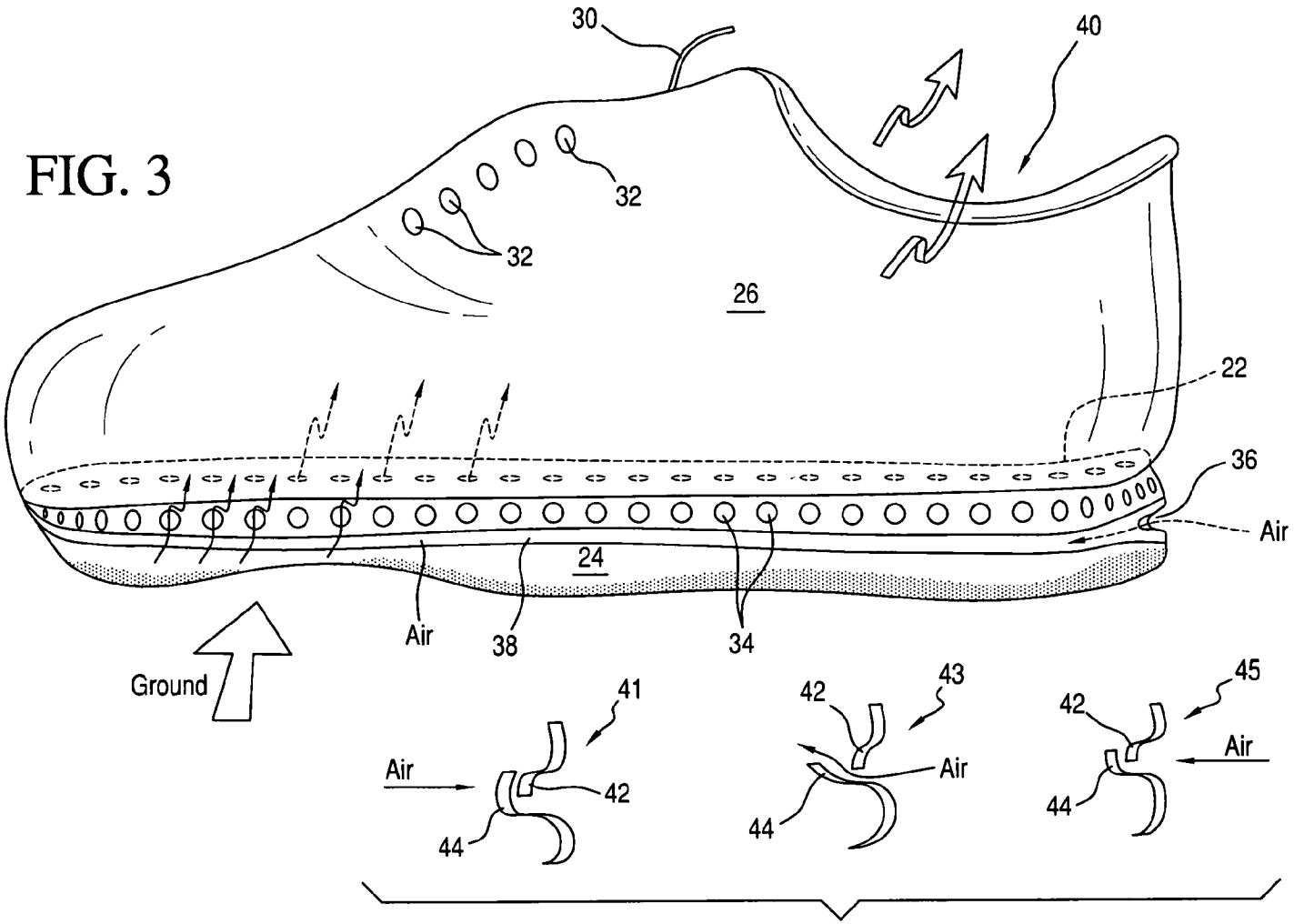
FIG. 3 is a side elevational view of the shoe shown in FIG. 1.
FIG. 4 is a side elevational view of a plurality of valves including a pair of generally S-shaped overlapping elements.

As shown in FIG. 4 the three valves 41, 43 and 45 are positioned on the inner side of the small openings 34 each includes a pair of S-shaped overlaying elements 42 and 44. Each of the elements may be made of a plastic sheet material that is molded into a S-shape but retains much of its flexibility. The overlapping elements open in one direction and air tends to separate the overlapping elements and valves 43 and 45 and enters into a shoe. On the other hand, air that strikes the valve from an opposite side tends to close the valve 41 as indicated by elements 42 and 44 and valve 41.

Figure 5A:
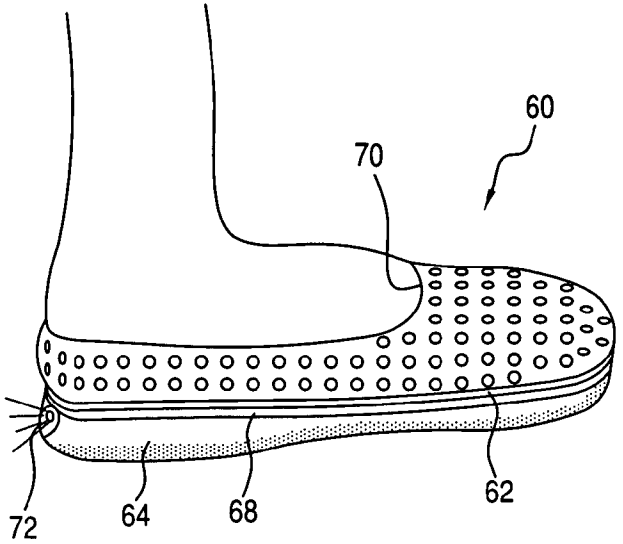
FIG. 5*a* is a schematic illustration of a slipper in accordance with a fourth embodiment of the invention.
Figure 5B:
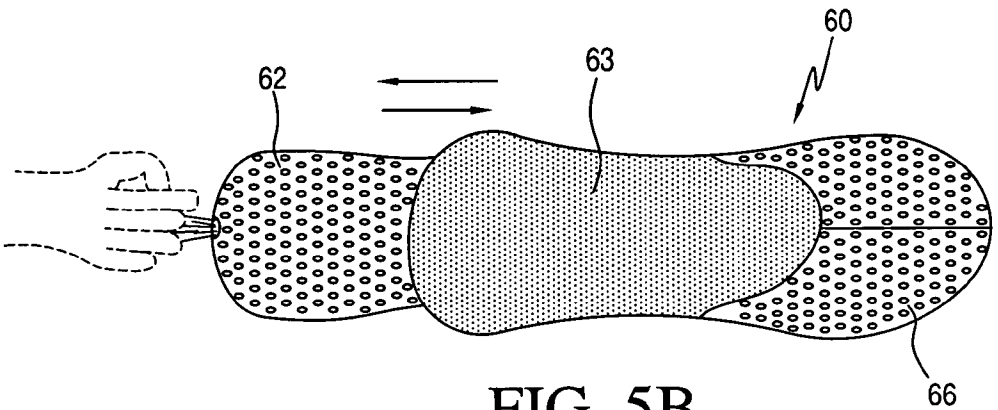
FIG. 5*b* is a top or plane view of the slipper shown in FIG. 5*a* with a deodorant and/or perfumed pad partially inserted into the slipper.
Figure 5C:
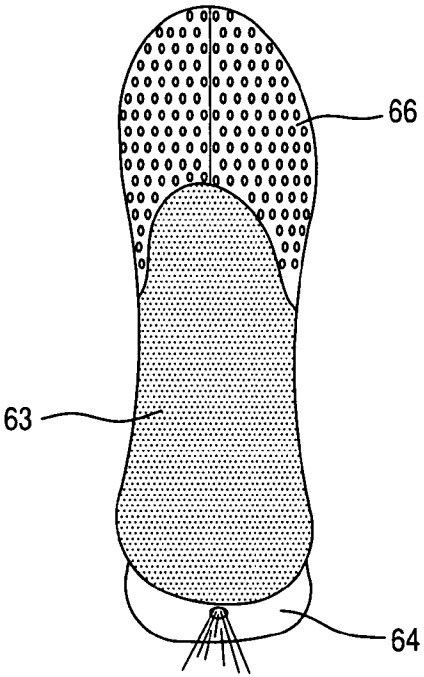
FIG. 5*c* is a top or plane view of a slipper in accordance with the slipper shown in FIGS. 5*a* and 5*b* but with a deodorant and/or perfumed pad fully inserted into the slipper.

A further embodiment of the invention is illustrated in FIGS. 5 *a*, 5 *b* and 5 *c* wherein a slipper 60 that is constructed in a similar manner to the shoe shown in FIGS. 1 and 3. Slipper 60 includes an open porous pad 62 that includes a deodorant and/or perfume impregnated therein. The slipper 60 also includes a relatively soft and flexible leather sole 64 and an upper slipper portion 66 and include a plurality of small openings but arranged in a similar manner to the shoe shown in FIGS. 1 and 3. The slipper 60 also includes a longitudinally extending air chamber as well as an opening 70 and valve 72 in the back of the slipper 60. The slipper 60 may also include a permanent insole of porous cloth or the like.

While the invention has been described in connection with its preferred embodiments it should be recognized that changes and modifications may be made therein without departing from the scope of the appended claims.

What is claimed is:

1. A ventilating shoe including a removable deodorant and/or perfumed pad, said shoe comprising:

a water resistant sole having an upper and a lower surface in the general shape of a human foot and an upper shoe portion with an opening and a tongue in an upper portion thereof;

a closing element for closing said opening to thereby envelop an individual's foot, and a connecting element for attaching said upper shoe portion to said sole and said shoe having a front, a back surface and two sides;

a first plurality of small openings between said sole and said upper shoe portion surrounding said sole on each side thereof with the exception of the back of said shoe;

an open porous pad and a deodorant and/or perfume impregnating said pad; said porous pad having a second plurality of openings along a peripheral edge thereof, and a third plurality of openings on an upper surface thereof, wherein said first, second, and third plurality of openings are in fluid communication with one another;

a longitudinally extending air chamber that extends along a length of the shoe and under said pressure pad and a vent and in a rear surface of said sole for admitting air into said chamber; and an opening in the back portion of said shoe for inserting and removing said porous pad.

2. The ventilating shoe according to claim 1 in which each of said small openings in said vent includes a pair of generally S-shaped overlapping elements to permit air into said shoe and slightly resist the out flow of air through said adjacent small openings.

3. The ventilating shoe according to claim 2 in which said upper shoe portion is leather.

4. The ventilating shoe according to claim 3 in which said sole is made of a rubber composition.

5. A ventilating shoe including a removable deodorant and/or perfumed pad, said shoe consisting of:

a water resistant rubber sole having an upper surface and a lower surface in the general shape of a human foot for contacting the ground, and a leather upper shoe portion with an opening, a tongue and a closing element for closing said opening in an upper portion thereof to thereby envelop an individual's foot and a connecting element attaching said upper shoe portion to said sole and said shoe having a front, a back and two sides;

a first plurality of small openings between said sole and said upper shoe portion surrounding said sole on each side thereof with the exception of the back of said shoe;

each of said small openings including a pair of generally S-shaped overlapping elements to permit ingress of air into said shoe and resisting the outflow of air through said adjacent small openings;

an open porous pad and a deodorant and/or perfume impregnating said pad; said porous pad having a second plurality of openings along a peripheral edge thereof, and a third plurality of openings on an upper surface thereof, wherein said first, second, and third plurality of openings are in fluid communication with one another;

a longitudinally extending air chamber that extends along a length of the shoe and under said porous pad and a vent in a rear surface of said sole for admitting air into said chamber; and an opening in a back portion of said shoe for inserting and removing said porous pad.

* * * * *